United States Patent [19]

Ohdai et al.

[11] Patent Number: 4,680,950

[45] Date of Patent: Jul. 21, 1987

[54] METHOD OF AND AN APPARATUS FOR FORMING TENSION SPRINGS WITH GERMAN TYPE HOOKS

[75] Inventors: Yozo Ohdai, Kasugai; Norifumi Abiru, Owariasahi; Eiji Ohbayashi, Kuwana, all of Japan

[73] Assignee: Asahi-Seiki Manufacturing Co., Ltd., Japan

[21] Appl. No.: 845,550

[22] Filed: Mar. 28, 1986

[30] Foreign Application Priority Data

Apr. 3, 1985 [JP] Japan ..... 60-70616

[51] Int. Cl.[4] ..... B21F 35/02

[52] U.S. Cl. ..... 72/130; 72/132; 72/137; 140/103

[58] Field of Search ..... 72/129, 130, 131, 132, 72/137, 371; 140/71 R, 103, 104

[56] References Cited

U.S. PATENT DOCUMENTS

| | | | |
|---|---|---|---|
| 3,025,889 | 3/1962 | Clay | 140/71 R |
| 3,025,890 | 3/1962 | Clay | 140/71 R |
| 3,025,891 | 3/1962 | Clay | 140/71 R |
| 3,026,012 | 3/1962 | Clay | 226/187 |
| 3,038,505 | 6/1962 | Clay | 140/71 R |
| 4,026,135 | 5/1977 | Yagusic et al. | 72/14 |
| 4,296,621 | 10/1981 | Ohdai et al. | 72/137 X |
| 4,485,851 | 12/1984 | Takumi | 72/137 X |
| 4,503,694 | 3/1985 | Takumi | 72/137 X |
| 4,542,635 | 9/1985 | Matsuoka | 72/137 X |
| 4,586,357 | 5/1986 | Allweier et al. | 72/137 |

FOREIGN PATENT DOCUMENTS

| | | |
|---|---|---|
| 37-6714 | 7/1962 | Japan . |
| 52-11306 | 3/1977 | Japan . |

*Primary Examiner*—E. Michael Combs
*Attorney, Agent, or Firm*—Parkhurst & Oliff

[57] ABSTRACT

A method of and an apparatus for continuously and automatically forming tension springs each provided at the opposite ends with German type hooks. Several forming tools are mounted on rocker arms which swing about respective axes offset from and perpendicular to a central axis of a wire guide. A wire stock is intermittenly fed by feed rolls to a wire guide to pass the wire guide. When the wire stock is positioned in front of the wire guide, it is acted upon by the forming tools to form a first hook a body coil and a second hook. Among the tools, a second forming tool forms hooks and a body coil, and a third forming tool twists and forces a leading end of a body coil toward a position offset from a surface of coil forming on the second forming tool when a one fourth of an initial turn of the body coil is formed. A stationary abutment tool bears against the leading end of the body coil which is displaced by the third forming tool. A first forming tool bends by more than 90 degrees a first hook or a linear portion of the first hook interposed between the third forming tool and the abutment tool. These forming tools are timingly actuated by a cam mechanism.

3 Claims, 24 Drawing Figures

METHOD OF AND AN APPARATUS FOR FORMING TENSION SPRINGS WITH GERMAN TYPE HOOKS

BACKGROUND OF THE INVENTION

This invention relates generally to a method of and an apparatus for forming tension springs with German type hook. More particularly, this invention relates to an improvement of machines of a rocker arm type disclosed in Japanese Patent Publication Nos. 6714/62 and 11306/77 which are capable of forming only tension springs with English type hook. In machines described in the above publications, a wire stock interposed between two feed rolls is fed through a hole formed in a wire guide, and when a forming tool provided on an end of a rocker arm is moved in front of the wire stock thus fed, which rocker arm is governed by a cam to swing at a position offset from the center of the wire guide relative to the wire about an axis transverse to the axis of the wire guide, first hook, body portion and a second hook of a tension spring with hooks on the opposite ends thereof are bent and formed. Thus, during the forming of a single tension spring, a wire stock is continuously fed and the forming tool is intermittently driven. Such operation is repeated for the forming of successive tension springs. However, this type of machine enables forming only tension springs with English type hook.

SUMMARY OF THE INVENTION

In one aspect of the invention, a small number of additional elements are added to the above type of machine, which is of a rocker arm type and in which a forming tool performs a small amount of movement, to enable forming tension springs with German type hook.

In another aspect of the invention, a small number of steps are added to those performed in the above type of machine to enable forming tension springs with German type hook.

According to the present invention, there is provided a method of forming a tension spring, in which a second forming tool mounted on a rocker arm adapted to swing in front of a wire guide for a wire stock interposed between feed rolls advances to abut against the wire stock, thereby forming hooks and a body coil, said method comprising the steps of temporarily suspending the continuous feeding of the wire stock during the forming of a single tension spring when a one fourth of an initial turn of a body coil is formed after a first hook is formed; interposing the leading end of the body coil between a third forming tool and an abutment tool at a position offset from a surface of coil forming; using a first forming tool to bend a hook by more than 90 degrees toward the surface of coil forming at a bending point corresponding to the point where the leading end of the body coil is interposed in the manner described above; successively forming a body coil; after the forming of the second hook and the linear portion thereof, holding and cutting the body coil from the wire stock, and then displacing a resulting tension spring to a position spaced away to grasp the same over again, thus bending the second hook.

According to the present invention, there is also provided a method of forming a tension spring, in which a second forming tool mounted on a rocker arm adapted to swing in front of a wire guide for a wire stock interposed between feed rolls advances to abut against the wire stock, thereby successively forming a first hook and a body coil, said method comprising the steps of temporarily suspending the continuous feeding of the wire stock during the forming of a single tension spring when a one fourth of an initial turn of a body coil is formed after a first hook or a linear portion contiguous to the first hook is formed; twisting the wire stock at a position offset from a surface of coil forming to interpose the leading end of a body coil between a third forming tool and an abutment tool; using a first forming tool to bend the first hook or the linear portion contiguous to the first hook by more than 90 degrees toward the surface of coil forming at a bending point corresponding to the point where the leading end of the body coil is interposed in the manner described above; and thereafter advancing a second forming tool while feeding the wire stock to successively form the body coil.

According to the present invention, there is also provided an apparatus comprising a third forming tool disposed on one side of a second forming tool which serves to form hooks and a body coil, said third forming tool serving to twist the body coil; an abutment tool for cooperating with the third forming tool to interpose therebetween the body coil which has been twisted toward the opposite side of the third forming tool; a first forming tool disposed below the abutment tool for bending a first hook; a first cam mechanism for relatively driving these tools; a first driving means for intermittently feeding the wire stock; a second driving means for feeding the wire stock during the forming of a body coil; a first holding means for holding a tension spring thus formed and displacing the same to a position spaced away; a cutter means for cutting the wire stock; a second holding means for grasping over again the tension spring thus displaced to hold the same and determining a bending point of a second hook; a bending tool for bending the second hook; and a second cam mechanism for bringing the first holding means, cutter means, second holding means and the bending tool into synchronism with the first cam mechanism and actuating them in association with one another.

DESCRIPTION OF THE PREFERRED EMBODIMENT

Figure 2:
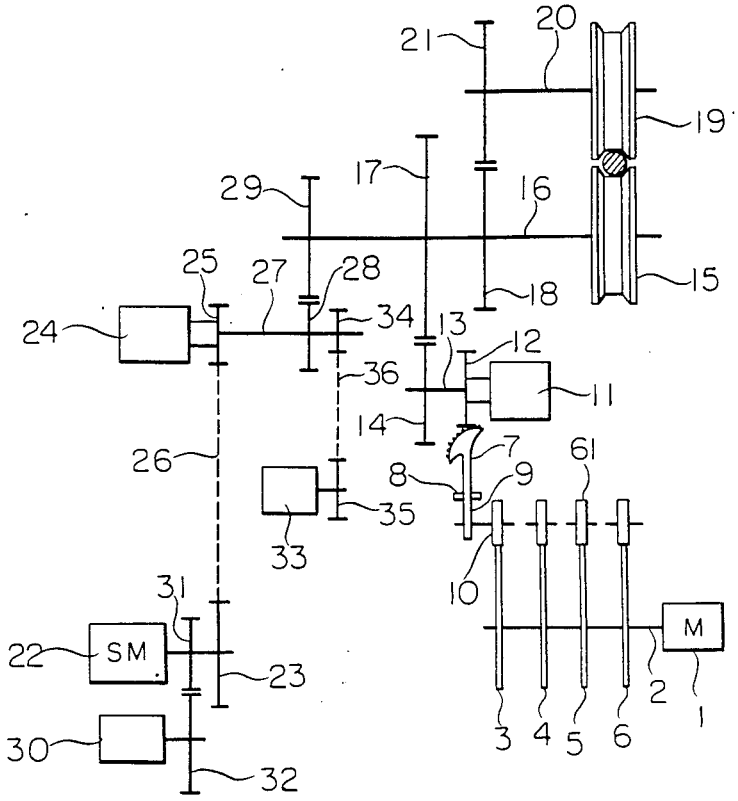
FIG. 2 is a diagrammatic view showing feed rolls.
Figure 10:
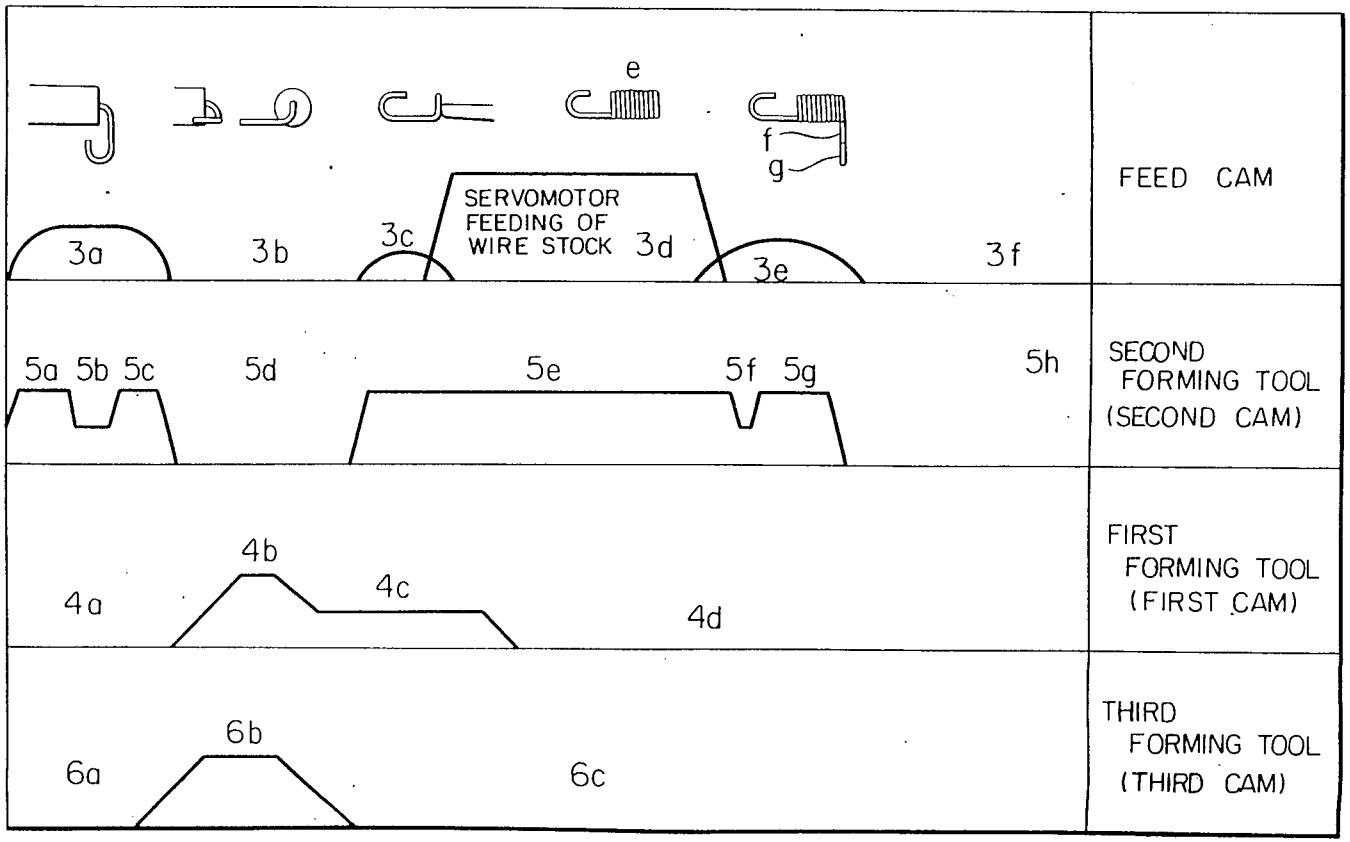
FIG. 10 is a view showing a timing chart of a feed cam, second, first and third forming tools during the forming of a tension spring.
Figure 11:
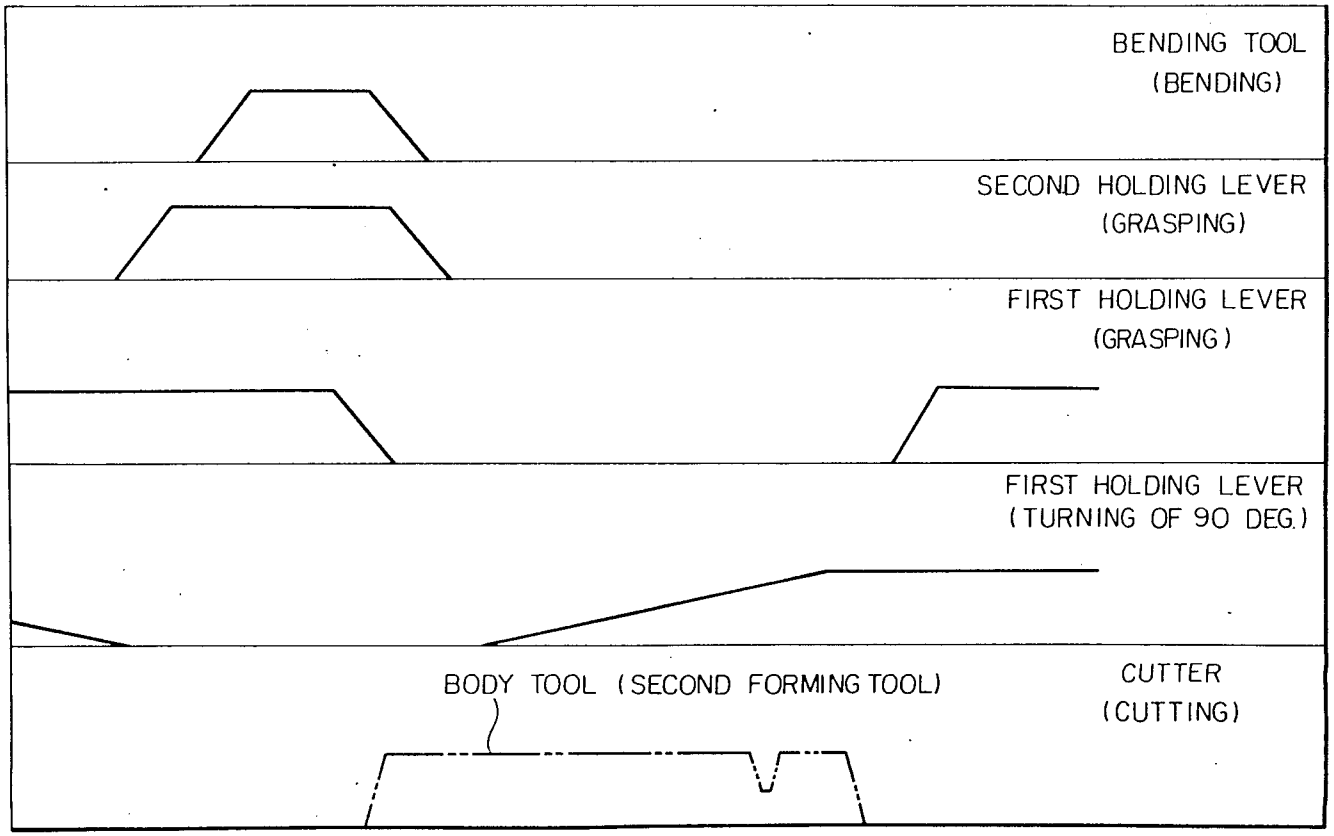
FIG. 11 is a timing chart performed when a second hook is bent.

Referring now to FIG. 2 of the drawings, a cam shaft 2 driven by a motor 1 mounts thereon a feed cam 3 having three lobes, a first cam 4 for driving a first forming tool, a second cam 5 for driving a second forming tool, and a third cam 6 for driving a third forming tool in parallel in such angular relationship that timing of operation shown in FIG. 10 is realized. The feed cam 3 is contacted by a cam follower 10 and is prevented by a spring (not shown) from being separated from the cam follower which is provided on one end of a lever 9 which in turn is swingable about a pivot 8 and is formed at its other end with a sector gear 7. The sector gear 7 meshes with a gear 12 provided on a one-way clutch 11, so that rotation of the gear 7 in one direction is transmitted to a cam shaft 13 and a gear 14 which in turn meshes with a gear 17 secured to a roll shaft 16 mounting thereon a feed roll 17. A gear 18 is secured to the feed roll 15 and meshes with a gear 21 which has the same number of teeth as those of the gear 18 and is secured to a roll shaft 20 mounting thereon a feed roll 19. Accordingly, the feed rolls 15 and 19 are rotated in opposite directions to cause a wire stock to be interposed between V-shaped surfaces thereof and be fed to an associated portion of the apparatus. While the feed of the wire stock is performed by a transmission device which comprises said cams, the feed of the wire stock during the forming of a coil is performed by a transmission device which comprises a servomotor. More specifically, a pulley 23 secured to an output shaft of a servomotor 22 is connected through a timing belt 26 to a pulley 25 mounted on a one-way clutch 24, and a gear 28 securedly mounted on a clutch shaft 27 of the one-way clutch 24 meshes with a gear 29 securedly mounted on the roll shaft 16 for the feed roll 15. An encoder 30 serves to detect rotation of the servomotor 22, that is, an amount of feed of the wire stock during the forming of a body coil, and is associated with the servomotor 22 through the engagement between the gear 31 on the output shaft of the servomotor 22 and a gear 32 on an input shaft of the encoder 30.

An encoder 33 is provided to detect rotation of the feed roll 15, that is, a total amount of feed of the wire stock, and a pulley 35 mounted on an input shaft of the encoder 33 is connected through a timing belt 36 to a pulley 34 mounted on a clutch shaft 27.

Figure 1:
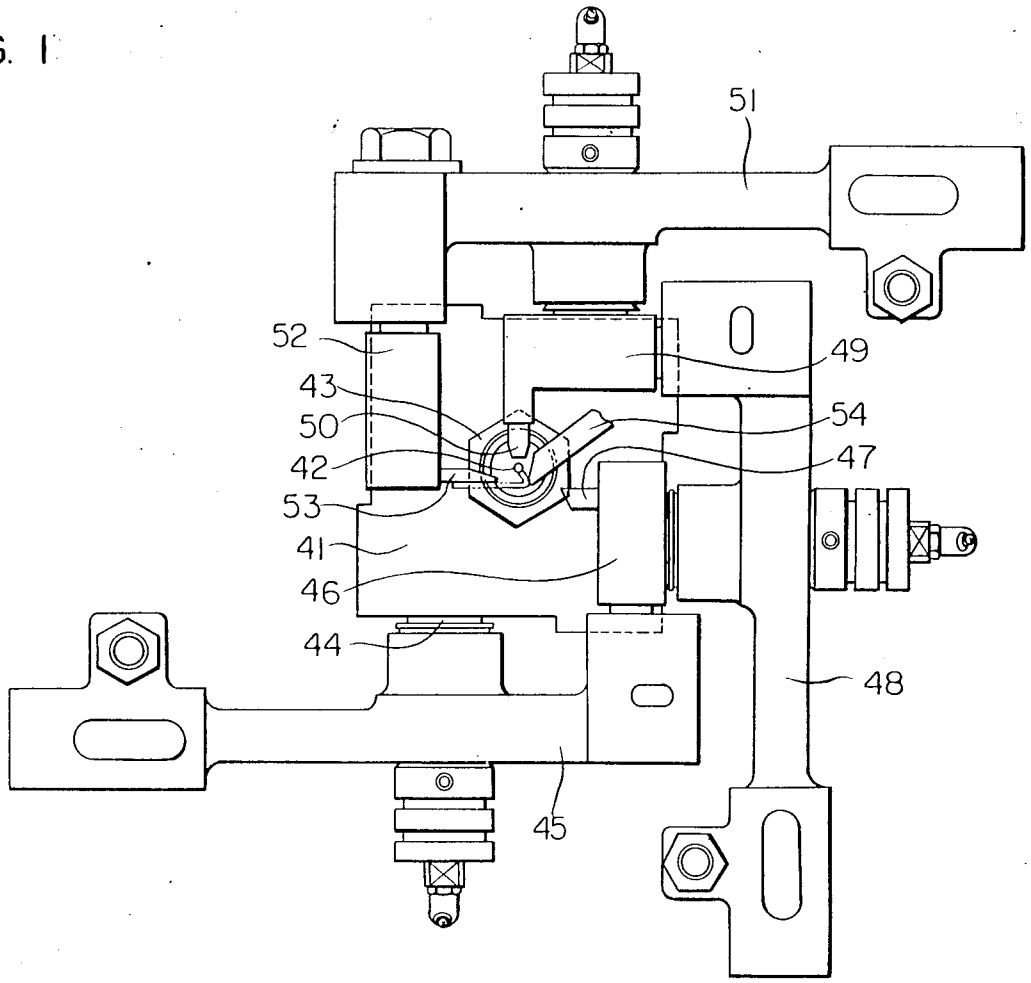
FIG. 1 shows a positional relationship among rocker arms, forming tools and an abutment tool.

Referring to FIG. 1, an arrangement of various forming tools is described. A wire guide 43 formed with a guide hole 42 which is coaxial with the axis of the wire stock interposed between the feed rolls 15 and 19 is mounted on a base plate 41 to protrude axially adjustably from the base plate which is disposed on the front surface of a framework containing therein a driving mechanism for feed of the wire stock. A first rocker arm 45 is supported on a pivot shaft 44 to be swingable generally about its center, and securedly mounts at its tip end a tool holder 46 which in turn mounts thereon a first forming tool 47 in such a position where the top surface of the first forming tool having a tip end formed to have an acute angle corresponds to a level by a distance of the radius of the body coil of a finished tension spring below the guide hole 42 of the wire guide 43. The pivot shaft 44 is disposed offset from the center of the wire guide 43. A second rocker arm 48 is similarly provided to be disposed transverse to the first rocker arm 45, and mounts thereon a tool holder 49 which in turn mounts at its tip end a second forming tool 50. An inclined surface of the second forming tool 50 facing the guide hole 42 is formed thereon with a forming groove which has a center aligned with the central axis of the guide hole of the wire guide. A third rocker arm 51 is provided to be parallel to the first rocker arm 45, and mounts thereon a tool holder 52 and a third forming tool 53 having a flat bottom surface which is in parallel to the first forming tool 47 and is disposed thereabove by a distance of a wire diameter on the side of the guide hole 42. The tip end of the third forming tool 53 is formed to have a small diameter and an acute angle.

The base plate 41 further secures thereto an abutment tool 54 which extends between the first and second forming tools in an upper right direction and has a tip end at a position slightly below the guide hole 42 and within a fourth quadrant as viewed in FIG. 1. The abutment tool 54 cooperates with the third forming tool to interpose therebetween the wire stock.

Figure 3:
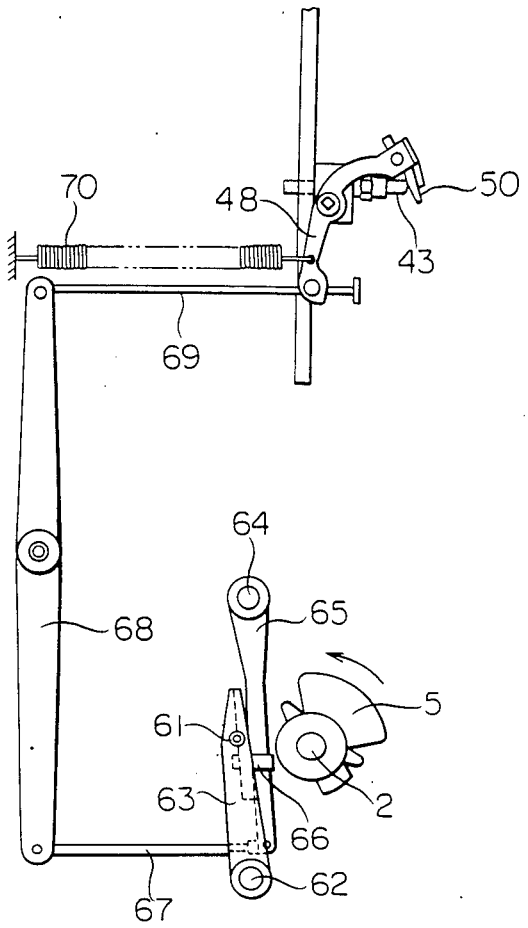
FIG. 3 is a view showing a drive for a rocker arm.
Figure 4:
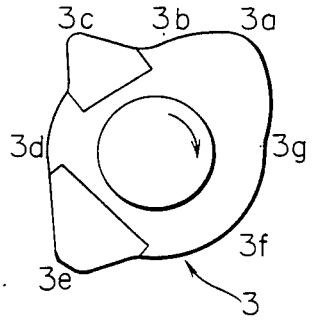
FIG. 4 is a view showing a feed cam.
Figure 5:
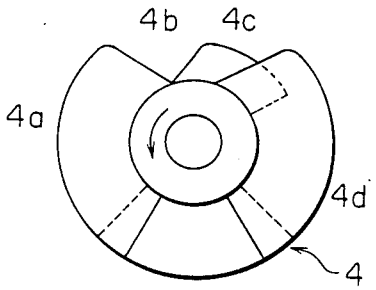
FIG. 5 is a view showing a first cam.
Figure 6:
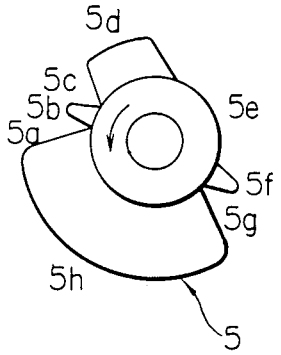
FIG. 6 is a view showing a second cam.
Figure 7:
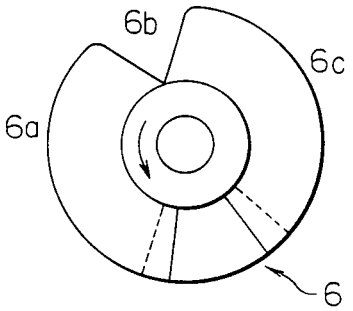
FIG. 7 is a view showing a third cam.

The relationship between the rocker arms and driving cams is described with reference to FIG. 3 which shows the action of the second forming tool 50.

A cam follower 61 contacted by the second cam 5 secured to the cam shaft 2 is rotatably supported on a cam lever 63 pivotally mounted on the shaft 62, and the cam lever 63 is connected through a connection 66 to a push lever 65 rotatably mounted on a shaft 64. The tip end of the push lever 65 is connected through a pin to a connecting rod 67, of which tip end is connected through a pin to an intermediate lever 68, of which other end is connected to a connecting rod 69 connected to the rear end of the second rocker arm 48. The rear end of the second rocker arm 48 is drawn by a tension spring 70 mounted on the framework, so that the cam follower 61 is caused to constantly contact with the second cam 5. The turning movement of the second rocker arm 48 caused by the second cam causes the second forming tool 50 to perform arcuate movement so that when the second forming tool 50 performs a generally linear movement at the top of the arcuate path, the forming groove of the second forming tool comes in front of the guide hole 42. Also, the first and third rocker arms 45 and 51 act when they are driven by the respective cams to be positioned at their generally linear movements. When a one fourth portion of a body coil to be described hereinbelow is formed, the third forming tool 53 advances to a position where it cooperates with the abutment tool 54 to twist the end of the body coil from the surface of coil forming to the fourth quadrant. The first forming tool 47 is adapted to advance to two positions, that is, a position below the abutment tool 54 and the third forming tool 53 and a position just before the surface of coil forming.

Figure 8:
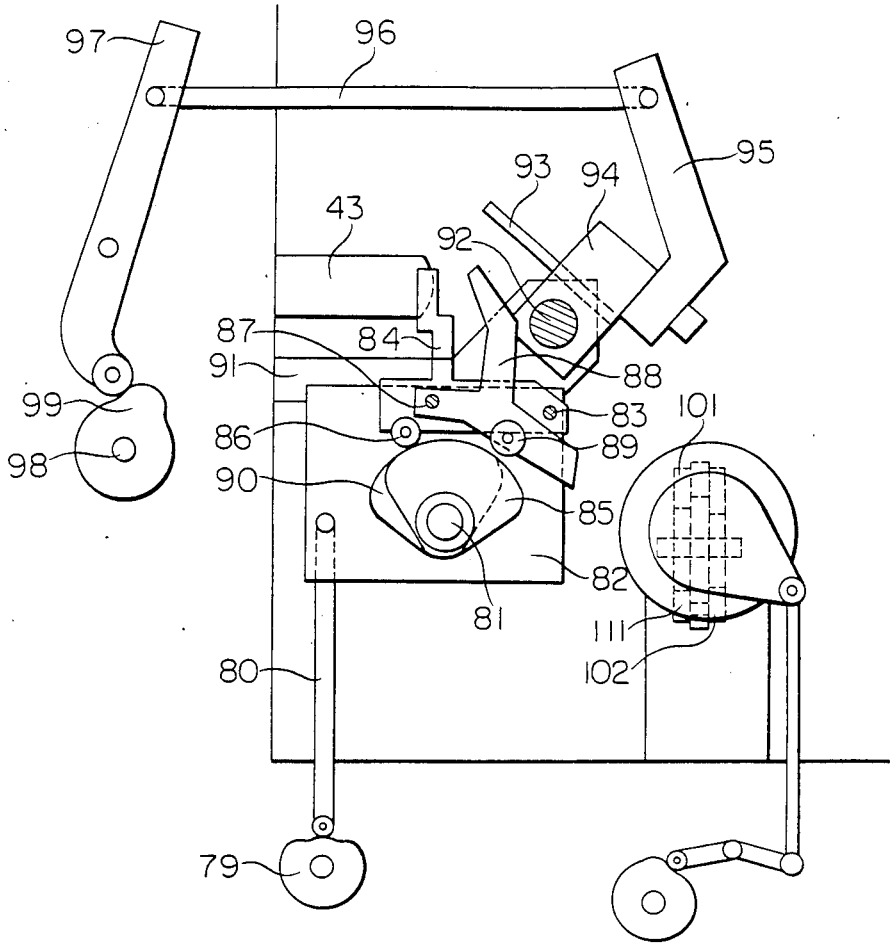
FIG. 8 is a view showing a positional relationship between a first holding lever and a cutter.
Figure 9:
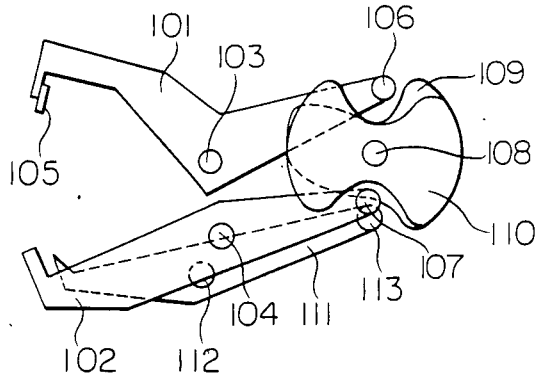
FIG. 9 is a view showing a second holding lever.

A mechanism for forming a second, German type hook is decribed with reference to FIGS. 8 and 9.

A frame 82 is rotatably mounted on a shaft 81 which is adapted to rotate in synchronism with the cam shaft 2 and is rotatably supported on the framework to be disposed below and transverse to the wire guide 43. In FIG. 8, one of first, inverse T-shaped holding levers 84 is pivotally mounted on the frame 82 at its upper left corner by means of a pivot 83, and a cam 85 secured to the shaft 81 acts to swing the first holding lever 84 through a cam follower 86 which is pivotally mounted on the first holding lever 84. The other of first, inverse T-shaped holding levers 88 is mounted on a pivot shaft 87 which is provided on one of the first holding lever 84 to be in parallel to the shaft 81. A cam 90 secured to the shaft 81 serves to doubly swing the other of the first holding lever 88 through a cam follower 89 mounted on the lever 88. These levers 84 and 88 are opened in a lower position when not influenced by the action of cams 85 and 90, and are closed to hold an end of the body coil of a tension spring on the side of a first hook when they are lifted to an upper position under the action of the cams. The frame 82 is caused by a cam 79 through a connecting rod 80 to turn by 90 degrees to a horizontal position with the tension spring held by the first holding levers 84 and 88.

Brackets 91 are provided below and on the opposite sides of the wire guide 43, and a shaft 92 are secured to the framework to extend through the brackets 91 and rotatably supports thereon a cutter holder 94 which secures thereto a cutter 93 at a position in front of the wire guide 43. A connecting plate 95 is mounted on the cutter holder 94 to extend upward, and is connected through a connecting rod 96 to a swing lever 97. A cam 99 securedly mounted on a shaft 98 adapted to rotate in synchronism with the cam shaft 2 causes the swing lever 97 to swing. With the above arrangement, the cutter 93 turns to a position in front of the wire guide to cut an end of the second hook when the body coil is held by the first holding levers 84 and 88. After the first holding levers 84 and 88, holding a tension spring, turn by 90 degrees together with the frame 82 a pair of second holding levers 101 and 102 act to hold the tension spring which is held by the first holding levers 84 and 88. The second holding levers are rockably mounted on shafts 103 and 104 parallel to the shaft of the wire guide 43 to face each other. One of the second holding levers 101 secures to its gripping end thereof an abutment plate 105 which serves to determine the bending position of a terminal end of a body coil which end is contiguous to the second hook, and pivotally mounts on its other end a cam follower 106. The other of the second holding levers 102 also has a gripping end and mounts on the other end thereof a cam follower 107. Cams 109 and 110 are securedly mounted on a shaft 108 which is parallel to the wire guide 43 and is adapted to rotate in synchronism with the cam shaft 2. The cam 109 acts on the cam follower 106, and the cam 110 acts on the cam follower 107 for the holding of a body coil of a tension spring being formed. A bending tool 111 is provided in juxtaposition with the other of the second holding levers 102 and is pivotally mounted on a shaft 112 which is in parallel with the shaft 104. The tip end of the bending tool 111 is wedge-shaped so as to raise the second hook of a tension spring, and a cam follower 113 pivotally mounted on the distal end of the bending tool 111 is acted on by the cam surface of the cam 109 after a tension spring is held by the second holding levers 101 and 102.

Figure 12A:
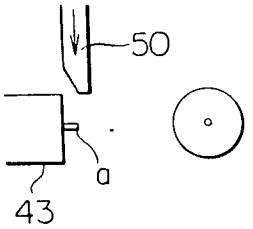
FIG. 12*a* to 12*m* are diagrammatic views illustrating steps of the forming of a tension spring.
Figure 12B:
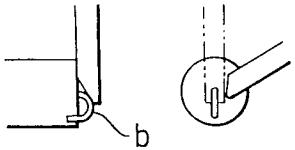

The procedure of the forming of a tension spring is described with reference to FIGS. 12*a* to 12*m*. Rotation of the motor 1 is transmitted through a reduction gear to the feed cam 3, first, second and third cams 4, 5 and 6 to simultaneously rotate them, so that the cam surface 3*a* of the feed cam 3 causes rotation of the lever 9 which rotation is transmitted through the gear 12, gear 14 secured to the clutch shaft of the one-way clutch 11, gears 17, 18, 21 to the roll shafts 16 and 20 to rotate the roll shafts in reverse directions, thereby feeding a wire stock interposed between the feed rolls 15 and 19 at a predetermined speed. Thus a linear portion a at the tip end of a first hook of a tension spring shown in FIG. 12*a* is formed. In the meantime, the second cam 5 rotates somewhat lately to present its cam surface portion 5*a* devoid of any lift, thereby allowing the second rocker arm 48 to turn, so that the second forming tool 50 comes in front of the guide hole 42 to engage with the wire stock for the forming of a semicircular portion b of the first hook shown in FIG. 12*b*. Then, a cam surface portion 5*b* of the second cam 5 which has a small lift presents itself to retreat the forming tool 50 from the wire stock, thus forming a linear portion c contiguous to the first hook of a tension spring shown in FIG. 12*c*.

Figure 12C:
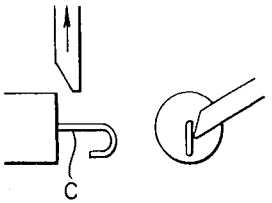
Figure 12D:
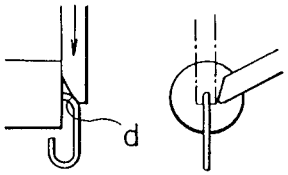
Figure 12E:
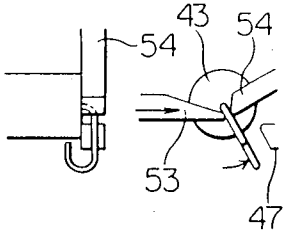

A cam surface portion 5*c* of the second cam 5 which is devoid of any lift presents itself to advance the second forming tool 50 for engagement with the wire stock, thereby forming a one fourth of a first turn of a body coil and orienting the wire stock downward as shown in FIG. 12*d*. Immediately after a cam surface portion 5*d* of the second cam 5 presents itself, the second forming tool 50 retreated, and a cam surface portion 3*b* of the feed cam 3 presents itself to turn the lever 9 in the reverse direction. This turning movement of the lever 9 causes slippage in the one-way clutch 11 to thereby have no influence on the feed rolls 15 and 19, thus suspending the feed of the wire stock. In the meantime, following after a cam surface portion 6*a* of the third cam 6, a cam surface portion 6*b* thereof presents itself to allow the third rocker arm 51 to turn, so that the third forming tool 53 advances to abut against the starting point of a body coil and twist the same in a counterclockwise direction in a plane of coil forming to interpose the above point of the body coil between it and the abutment tool 54 in a position within a fourth quadrant.

Figure 12F:
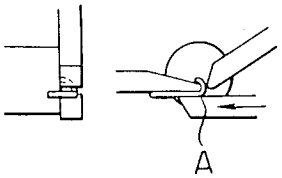
Figure 12G:
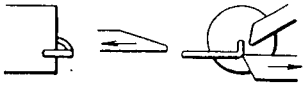

The first cam 4 rotates to present its cam surface portion 4*b* after its cam surface portion 4*a*, thus allowing the first rocker arm 45 to turn to advance the first forming tool 47 below the point A by a distance corresponding to the diameter of the wire stock, at which point A the coil is caught as shown in FIG. 12*f*. Thus the first forming tool 47 forces leftward the linear portion c contiguous to the first hook b to bend the same by more than 90 degrees along the underside of the third forming tool 53. The first cam 4 rotates to present its cam surface portion 4*c* having a small lift, so that the first cam forming tool 47 retreats slightly from the plane of coil forming, and the third cam 6 presents its cam surface portion 6*c* to retreat the third forming tool 53 as shown in FIG. 12*g*. In this position, the coil having a one fourth of a turn returns to the plane of coil forming owing to the righting moment produced in the portion of the wire extending beyond the one fourth portion of a turn since the wire stock is strongly interposed between the feed rolls 15 and 19. Spring back force causes the linear portion c of the first hook to turn 90 degrees toward a direction transverse to the wire guide 43. The second cam 5 rotates to present its cam surface portion 5*e* which has no lift on its surface, thus allowing the second forming tool 50 to advance, and the feed cam 3 presents its cam surface portion 3*c* to allow the wire stock to be fed and to abut against the forming groove of the second forming tool 50, thereby forming a body coil to extend the same toward the side of the wire guide. The end of the first forming tool 47 at which the first one of several turns of the body coil are positioned on their way abuts against the side of the wire stock to correct the same so as to eliminate any gaps between the respective turns of the body coil (such action is not necessarily needed). While the feed cam 3 is feeding the wire stock, the servomotor 22 is dictated to rotate, so that rotation is transmitted through the pulleys 23 and 25 to the one-way clutch 24. The cam surface portion 3*c* of the feed cam 3 causes the lever 9 to effect turning movement which is transmitted to the roll shaft 16, and then to the clutch shaft 27 through the gears 29 and 28. As the rotation of the servomotor 22 is increased in speed, rotation of the clutch shaft 27 in the same direction as that of the servomotor 22 is transmitted to the roll shafts 16 and 20 through the gears 28 and 29 when exceeded in speed by the rotation of the servomotor 22. The resulting high speed rotation of the feed rolls 15 and 19 causes high speed feeding of the wire stock to be formed into a body coil as shown in FIG. 12*h*. In the meantime, the clutch shaft 13 of the one-way clutch 11 is subjected to slippage. Shortly after the cam surface portion 3*c* of the feed cam 3 allows the servomotor 22 to rotate for the feeding of the wire stock, the cam surface portion 3*d* of the feed cam 3 having no lift comes into position, so that rotation of the feed cam 3 tending to rotate the feed rolls 15 and 19 for the feeding of the wire stock is stopped. When the servomotor 22 decelerates to stop just before the completion of forming of the body coil, the cam surface portion 3*e* of the feed cam 3 comes into position to cause the lever 9 to rotate the feed rolls 15 and 19, so that wire stock is fed by the cam when the servomotor 22 decelerates. In the meantime, the cam surface portion 5*f* of the second cam 5 having a small lift comes into position to cause the second forming tool 50 to temporarily retreat to a position away from the wire stock.

Accordingly, the wire stock is not restrained to form a linear portion of a predetermined length forwardly of the guide hole 42 as shown in FIG. 12*c*.

Figure 12J:
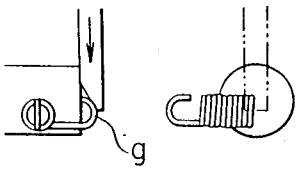
Figure 12I:
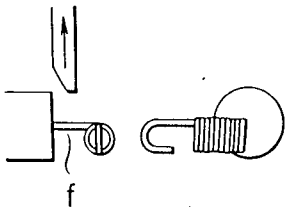
Figure 12H:
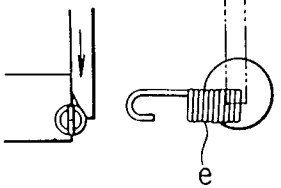

When the cam surface portion 5*g* of the second cam 5 comes into position to allow the second forming tool 50 to advance and abut against the wire stock thus fed, thereby forming an arcuate portion g of the second hook as shown in FIG. 12*j*. When the cam surface portion 5*h* of the second cam 5 comes into position to cause the second forming tool 50 to retreat, the wire stock is linearly fed to form a short, linear portion h at the tip end of the second hook. Upon rotation of the feed cam 3, its cam surface portion 3*f* comes into position to stop the feeding of the wire stock. Upon rotation of the cams 85 and 90, the first holding levers 84 and 88 pivotally supported by the frame 82 which in turn is rotatably mounted on the shaft 81 disposed forwardly of the base plate turn to come close to each other and rise so that they grasp a portion of the body coil extending sidewise of the wire guide 43 and disposed on the side of the first hook in a manner shown in FIG. 12*k*. Then, the cutter 93 turns from above under the action of the cam 99 to cut the wire stock at the outlet of the wire guide 43.

Figure 12M:
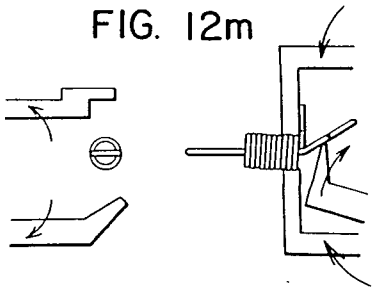
Figure 12L:
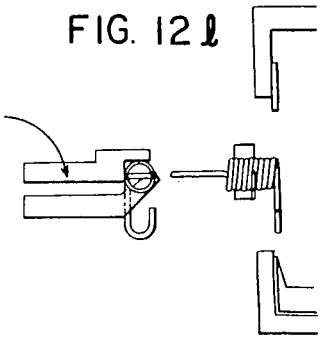
Figure 12K:
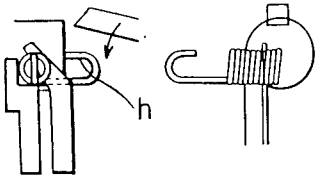

The first holding levers 84 and 88 grasp the resulting tension spring and turns horizontally 90 degrees to a bending position where the second hook g and the linear portion f are disposed below as shown in FIG. 12*l*. The second holding levers 101 and 102 turn about the shafts 103 and 104 under the action of the cams 109 and 110 to come close to each other, thereby grasping a portion of the body coil adjacent to the second hook thereof while the first holding levers 84 and 88 turn away from each other to release the body coil. At this time, the abutment plate 105 secured to the tip end of the second holding lever 101 extends along the end surface of the body coil adjacent to the second hook with the tip end of the abutment plate disposed at the terminal end of the body coil at a level above the first hook by a distance of about half the wire diameter. Shortly after the second holding levers 101 and 102 complete their holding of the body coil, another cam surface of the cam 109 causes the bending tool 111 to turn upward from below to come into contact with the rear side of the linear portion f of the second hook, thereby raising and bending the same by 90 degrees, as shown in FIG. 12*m*. When the bending tool 111 retreats, spring back force causes the second hook g and the linear portion f to be positioned perpendicular to the surface of the body coil, thus forming a tension spring provided at the opposite ends with German type hooks. The position of the tip end of the abutment tool 54, an amount of twist of a body coil produced by the advancing movement of the third forming tool 53 and an amount of bending of the second hook caused by the bending tool 111 are experimentally determined for a tension spring being manufactured.

As stated above, the present invention enables forming a tension spring provided at the opposite ends with German type hooks bent by 90 degrees relative to a body coil in a spring manufacturing apparatus of a rocker arm type, by temporarily stopping the feeding of a wire stock in a process of manufacture, holding a wire stock which shall be twisted at a coil starting position of a body coil, bending a portion of the wire stock on the side of a hook by more than 90 degrees, bending a second hook by more than 90 degrees, and utilizing the righting moment of a twist of the wire stock and spring back force. According to the present invention, simple tools are added to an apparatus for forming only a tension spring with English type hook, to improve the capability of the apparatus in a manner to form a tension spring with German type hook without increasing any manufacturing cost and the number of manufacturing steps.

What is claimed is:

1. A method of continuously and automatically forming tension springs provided at the opposite ends with German type hooks, comprising the steps of: feeding a length of linear wire stock for a first hook; forming a first hook; forming a linear portion contiguous to the first hook; forming a one fourth of an initial turn of a body coil contiguous to said linear portion; restraining and twisting a coil portion having said one fourth of a turn to a position offset from a plane of coil forming; bending the linear portion of said first hook by more than 90 degrees toward said plane of coil forming at said one fourth turn of the body coil; releasing said twist and restraint on said bent wire stock so that the linear portion of said first hook turns 90 degrees relative to said plane of coil forming due to the influence of a torsional righting moment created by said twist and a spring back force induced by said bending to effect a desired bend angle in said first hook; forming a body coil having a predetermined number of turns; forming a linear portion contiguous to the body coil; forming a second hook contiguous to said linear portion; forming a linear portion at a tip end of said second hook; grasping a portion of the body coil; cutting the wire stock at the tip end of said second hook; displacing said cut tension spring to a position away from a position of forming with the second hook and the linear portion thereof directed in a predetermined direction; again grasping the body coil and bending the linear portion of said second hook by more than 90 degrees at a specified point on said linear portion of said second hook.

2. A method of forming German type hooks on a tension spring, in which a first hook, a body coil and a second hook are successively formed to provide a tension spring by means of forming tools provided on ends of rocker arms controllably swung about axes perpendicular to and offset from a central axis of a wire guide and relative to a length of wire stock advanced in front of said wire guide by means of a pair of feed rolls, said method comprising the steps of: forming a first hook with a contiguous linear portion thereon, temporarily suspending the feeding of the wire stock advancing a second forming tool and forming approximately a one fourth of an initial turn of the body coil contiguous to said linear portion after the first hook and its contiguoug linear portion are formed; advancing a third forming tool and twisting a coil portion having said one fourth of an initial turn to thereby displace a starting point of a body coil to a position offset from a forming plane of a body coil while interposing said coil portion between the third forming tool and a stationary abutment tool; advancing a first forming tool and bending the linear portion of said first hook by more than 90 degrees toward said forming plane of the body coil at a point where said coil portion is interposed between the third forming tool and the abutment tool; withdrawing all of said tools from said formed first hook to effect turning of the linear portion thereof 90 degrees relative to said starting point of said body coil due to the influence of a torsional righting moment created by the twist induced in the wire stock extending from a point where it is interposed between said feed rolls, and a spring back force induced after the bending by more than 90 degrees, to form a German type hook which extends substantially perpendicular to the surface of the body coil advancing a second forming tool into contact with said wire stock while continuously feeding said stock to form a body coil; and then forming a second German type hook on an opposite end of said body coil.

3. An apparatus for continuously and automatically forming tension springs provided at the opposite ends with German type hooks, in which a first hook, a body coil and a second hook are successively formed when forming tools provided on ends of rocker arms controllably swung about axes perpendicular to and offset from a central axis of a wire guide relative to a length of wire stock advanced in front of the wire guide by means of a pair of feed rolls, said apparatus comprising a second forming tool for forming said hooks and said body coil; a third forming tool for twisting and forcing a starting point of a one fourth of an initial turn of said body coil toward a position on one side of and offset from a side forming surface of said second forming tool; an stationary abutment tool provided on a side opposite to said third forming tool for receiving said starting point of the body coil thus displaced; a first forming tool for bending a linear portion of said first hook by more than 90 degrees toward said forming surface with said first hook interposed between said third forming tool and said abutment tool on a side adjacent said abutment tool; a first cam mechanism for actuating said first, second and third forming tools, respectively, at relatively timed points; a first driving means for driving said feed rolls through a one-way clutch to intermittently feed said wire stock; a second driving means for driving said feed rolls through a one-way clutch to feed the wire stock when a body coil is to be formed; a first holding member for holding and displacing a body coil of a tension spring in a predetermined, spaced position, which tension spring has a formed first hook, a body coil and a second hook located adjacent said wire guide; a cutter for cutting an end of said second hook of the tension spring held by said first holding member; a second holding member including an abutment plate for receiving and holding the body coil of the tension spring displaced from said first holding member and having a tip end adapted to be disposed at a terminal point of said body coil when it is held in said second holding member; a bending tool for cooperating with said abutment plate to bend a linear portion of the second hook of the tension spring held by said second holding member by more than 90 degrees; and a second cam mechanism for relatively actuating said first holding member, said cutter, said second holding member and said bending tool in synchronism with said first cam mechanism.

* * * * *